US011391164B2

(12) United States Patent
Bruni et al.

(10) Patent No.: US 11,391,164 B2
(45) Date of Patent: Jul. 19, 2022

(54) COMPRESSOR AEROFOIL

(71) Applicant: Siemens Energy Global GmbH & Co. KG, Munich (DE)

(72) Inventors: Giuseppe Bruni, Lincoln (GB); Senthil Krishnababu, Lincoln (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 332 days.

(21) Appl. No.: 16/619,621

(22) PCT Filed: Jun. 14, 2018

(86) PCT No.: PCT/EP2018/065820
§ 371 (c)(1),
(2) Date: Dec. 5, 2019

(87) PCT Pub. No.: WO2019/001979
PCT Pub. Date: Jan. 3, 2019

(65) Prior Publication Data

US 2020/0141249 A1 May 7, 2020

(30) Foreign Application Priority Data

Jun. 26, 2017 (EP) ..... 17177900

(51) Int. Cl.
*F01D 5/20* (2006.01)
*F01D 5/14* (2006.01)
(Continued)

(52) U.S. Cl.
CPC ..... *F01D 5/20* (2013.01); *F01D 5/141* (2013.01); *F04D 29/324* (2013.01);
(Continued)

(58) Field of Classification Search
None
See application file for complete search history.

(56) References Cited

U.S. PATENT DOCUMENTS 8,246,307 B2 * 8/2012 Cheong ..... F01D 5/20 416/97 R
10,458,427 B2 * 10/2019 McGill ..... F04D 29/324
(Continued)

FOREIGN PATENT DOCUMENTS

EP 2725194 A1 4/2014
EP 2987956 A1 2/2016
(Continued)

OTHER PUBLICATIONS

International search report and written opinion dated Sep. 20, 2018 for corresponding PCT/EP2018/065820.

*Primary Examiner* — Courtney D Heinle
*Assistant Examiner* — Jason Fountain

(57) ABSTRACT

A compressor aerofoil rotor blade for a turbine engine includes: a root portion spaced apart from a tip portion by a main body portion. The main body portion is defined by a suction surface wall having a suction surface and a pressure surface wall having a pressure surface. The suction surface wall and the pressure surface wall meet at a leading edge and a trailing edge. The tip portion comprises a shoulder provided on the pressure surface wall. A tip wall extends from the aerofoil leading edge to the aerofoil trailing edge. A transition region of the pressure surface wall tapers from the shoulder in a direction towards the tip wall. The tip wall includes a squealer defined by a first tip wall region which extends from the trailing edge to a winglet.

14 Claims, 6 Drawing Sheets

A-A

(51) Int. Cl.
*F04D 29/32* (2006.01)
*F04D 29/54* (2006.01)

(52) U.S. Cl.
CPC ..... *F04D 29/544* (2013.01); *F05D 2240/123* (2013.01); *F05D 2240/305* (2013.01); *F05D 2240/306* (2013.01); *F05D 2240/307* (2013.01); *F05D 2250/712* (2013.01); *F05D 2260/202* (2013.01)

(56) References Cited

U.S. PATENT DOCUMENTS

| | | | | |
|---|---|---|---|---|
| 2005/0220627 | A1 | 10/2005 | Goodman | |
| 2010/0098554 | A1* | 4/2010 | Cheong | F01D 5/20 416/97 R |
| 2017/0058680 | A1 | 3/2017 | Chouhan et al. | |
| 2017/0218976 | A1* | 8/2017 | McGill | F04D 29/544 |
| 2018/0298912 | A1* | 10/2018 | Hall | F01D 5/20 |

FOREIGN PATENT DOCUMENTS

| | | | |
|---|---|---|---|
| EP | 3138997 | A1 | 3/2017 |
| RU | 2568355 | C2 | 11/2015 |

* cited by examiner

| Parameter | Value |
|---|---|
| $h_{2A}=h_{2B}$ | 1.5 to $3.5h_g$ |
| $h_{1A}=h_{1B}$ | 1.5 to $2.7h_{2A}$ |
| $W_{3A}$ | 0.8 to $0.95W_{bA}$ |
| $W_{2A}$ | 0.8 to $0.95W_{3A}$ |
| $W_{1A}$ | 0.4 to $0.6W_{2A}$ |
| $W_{1B}$ | 0.1 to $0.2W_{bB}$ |
| $L_1$ | 0.25 to 0.65L |
| $L_2$ | 0.4 to $0.6L_1$ |

COMPRESSOR AEROFOIL

CROSS REFERENCE TO RELATED APPLICATIONS

This application is the US National Stage of International Application No. PCT/EP2018/065820 filed 14 Jun. 2018, and claims the benefit thereof. The International Application claims the benefit of European Application No. EP17177900 filed 26 Jun. 2017. All of the applications are incorporated by reference herein in their entirety.

FIELD OF INVENTION

The present invention relates to a compressor aerofoil.

In particular it relates to a compressor aerofoil rotor blade and/or compressor aerofoil stator vane for a turbine engine, and/or a compressor rotor assembly.

BACKGROUND

A compressor of a gas turbine engine comprises rotor components, including rotor blades and a rotor drum, and stator components, including stator vanes and a stator casing. The compressor is arranged about a rotational axis with a number of alternating rotor blade and stator vane stages, and each stage comprises an aerofoil.

The efficiency of the compressor is influenced by the running clearances or radial tip gap between its rotor and stator components. The radial gap or clearance between the rotor blades and stator casing and between the stator vanes and the rotor drum is set to be as small as possible to minimise over tip leakage of working gases, but sufficiently large to avoid significant rubbing that can damage components. The pressure difference between a pressure side and a suction side of the aerofoil causes the working gas to leak through the tip gap. This flow of working gas or over-tip leakage generates aerodynamic losses due to its viscous interaction within the tip gap and with the mainstream working gas flow particularly on exit from the tip gap. This viscous interaction causes loss of efficiency of the compressor stage and subsequently reduces the efficiency of the gas turbine engine.

Two main components to the over tip leakage flow have been identified, which is illustrated in FIG. 1, which shows an end on view of a tip 1 of an aerofoil 2 in situ in a compressor, thus showing a tip gap region. A first leakage component "A" originates near a leading edge 3 of the aerofoil at the tip 1 and which forms a tip leakage vortex 4, and a second component 5 that is created by leakage flow passing over the tip 1 from the pressure side 6 to the suction side 7. This second component 5 exits the tip gap and feeds into the tip leakage vortex 4 thereby creating still further aerodynamic losses.

Hence an aerofoil design which can reduce either or both tip leakage components is highly desirable.

SUMMARY

According to the present disclosure there is provided apparatus as set forth in the appended claims. Other features of the invention will be apparent from the dependent claims, and the description which follows.

Accordingly there may be provided a compressor aerofoil (70) for a turbine engine, the compressor aerofoil (70) comprising: a root portion (72) spaced apart from a tip portion (100) by a main body portion (102). The main body portion (102) may be defined by: a suction surface wall (88) having a suction surface (89), a pressure surface wall (90) having a pressure surface (91), whereby the suction surface wall (88) and the pressure surface wall (90) meet at a leading edge (76) and a trailing edge (78). The tip portion (100) may comprise: a shoulder (104) provided on the pressure surface wall (90) between the leading edge (76) and the trailing edge (78); a tip wall (106) which extends from the aerofoil leading edge (76) to the aerofoil trailing edge (78); a transition region (108) of the pressure surface wall (90) which tapers from the shoulder (104) in a direction towards the tip wall (106). The tip wall (106) may comprise: a squealer (110) defined by a first tip wall region (112) which extends from the trailing edge (78) to a winglet (114) defined by a second tip wall region (116) which increases in width relative to the first tip wall region (112) to a tip wall widest point (A-A), and then reduces in width towards the leading edge (76).

The first tip wall region (112) which defines the squealer (110) may have a substantially constant width w1B along its extent. The first tip wall region (112) which defines the squealer (110) may have a substantially constant width w1B along at least part of its extent.

The distance between pressure surface (91) and the suction surface (89) of the main body (102) along the extent of the squealer is wbB, wherein the squealer width w1B may have a value of at least 0.1 wbB but no more than 0.2 wbB.

A chord line from the leading edge (76) to the trailing edge (78) has a length L; and the winglet (114) extends from the leading edge (76) towards the trailing edge (78) by a distance L1, where L1 may have a value of at least 0.25 L but no more than 0.65 L.

The widest point (A-A) of the winglet (114) is at a distance of L2 from the leading edge (76), where L2 may have a value of at least 0.4 L1 but no more than 0.6 L1.

Along the length of the winglet (114), the winglet (114) may be narrower than a distance wbA between the pressure surface (91) and the suction surface (89) in the corresponding region of winglet (114).

Along the length of the winglet (114), the winglet (114) may be recessed beneath the pressure surface (91).

The widest point (A-A) of the winglet (114) may have a width w3A of at least 0.8 wbA but no more than 0.95 wbA.

The tip wall (106) may define a tip surface (118) which extends from the aerofoil leading edge (76) to the aerofoil trailing edge (78). At the widest point (A-A) of the winglet (114): the transition region (108) of the pressure surface wall (90) may extend from the shoulder (104) in a direction towards the suction surface (89), and at an inflexion point (120) the transition region (108) may curve to extend in a direction away from the suction surface (89) toward the tip surface (118).

The tip portion (100) may further comprise an inflexion line (122) defined by a change in curvature on the pressure surface (91); the inflexion point (120) being provided on the inflexion line (122). The inflexion line (122) may extend between the leading edge (76) and the trailing edge (78).

The inflexion line (122) is provided a distance h2A, h2B from the tip surface (118); and the shoulder (104) is provided a distance h1A, h1B from the tip surface (118); where distance h1A, h1B may have a value of at least 1.5 h2A but no more than 2.7 h2A.

The inflexion line (122) at the widest point of the winglet (114) is provided a distance w2A from the suction surface (89); wherein w2A may have a value of at least 0.8 w3A but no more than 0.95 w3A.

The pressure surface (91) and the suction surface (89) are spaced apart by a distance wbA, wbB. The distance wbA, wbB may decrease in value between the main body widest point (A-A) and the leading edge (76). The distance wbA, wbB may decrease in value between the main body widest point (A-A) and the trailing edge (78).

There may also be provided a compressor rotor assembly for a turbine engine, the compressor rotor assembly comprising a casing and a compressor aerofoil according to the present disclosure, wherein the casing and the compressor aerofoil (70) define a tip gap hg defined between the tip surface (118) and the casing (50).

The distance h2A, h2B from the inflexion line (122) to the tip surface (118) may have a value of at least 1.5 hg but no more than 3.5 hg.

Hence there is provided an aerofoil for a compressor which is reduced in thickness towards its tip to form a squealer on the suction (i.e. convex) side of the aerofoil. In addition a winglet type extension is provided on the pressure (i.e. concave) side near the leading edge. Together, these features reduce the tip leakage mass flow thus diminishing the strength of the interaction between the leakage flow and the main stream flow which in turn reduces loss in efficiency relative to examples of the related art.

Hence the compressor aerofoil of the present disclosure provides a means of controlling losses by reducing the tip leakage flow.

BRIEF DESCRIPTION OF THE DRAWINGS

Examples of the present disclosure will now be described with reference to the accompanying drawings, in which.

DETAILED DESCRIPTION

Figure 2:
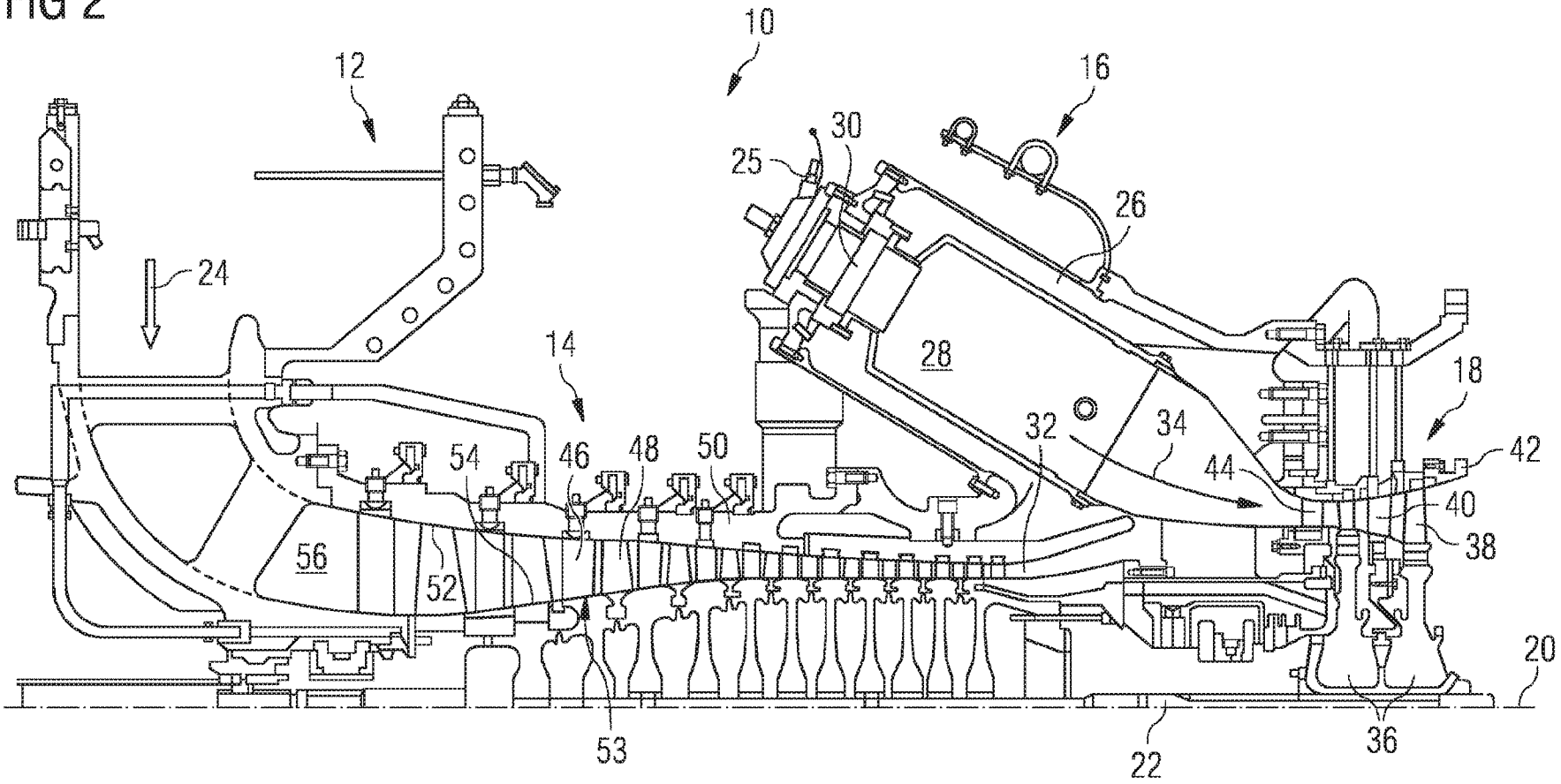
FIG. 2 shows part of a turbine engine in a sectional view and in which an aerofoil of the present disclosure may be provided.

FIG. 2 shows an example of a gas turbine engine 10 in a sectional view which may comprise an aerofoil and compressor rotor assembly of the present disclosure.

The gas turbine engine 10 comprises, in flow series, an inlet 12, a compressor section 14, a combustor section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 and at least one burner 30 fixed to each combustion chamber 28.

The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the resulting combustion gas 34 or working gas from the combustion is channelled through the combustion chamber 28 to the turbine section 18.

The turbine section 18 comprises a number of blade carrying discs 36 attached to the shaft 22. In addition, guiding vanes 40, which are fixed to a stator 42 of the gas turbine engine 10, are disposed between the stages of annular arrays of turbine blades 38. Between the exit of the combustion chamber 28 and the leading turbine blades 38, inlet guiding vanes 44 are provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

Compressor aerofoils (that is to say, compressor rotor blades and compressor stator vanes) have a smaller aspect ratio than turbine aerofoils (that is to say, turbine rotor blades and turbine stator vanes), where aspect ratio is defined as the ratio of the span (i.e. width) of the aerofoil to the mean chord (i.e. straight line distance from the leading edge to the trailing edge) of the aerofoil. Turbine aerofoils have a relatively large aspect ratio because they are necessary broader (i.e. wider) to accommodate cooling passages and cavities, whereas compressor aerofoils, which do not require cooling, are relatively narrow.

Compressor aerofoils also differ from turbine aerofoils by function. For example compressor rotor blades are configured to do work on the air that passes over them, whereas turbine rotor blades have work done on them by exhaust gas which passes over them. Hence compressor aerofoils differ from turbine aerofoils by geometry, function and the working fluid which they are exposed to. Consequently aerodynamic and/or fluid dynamic features and considerations of compressor aerofoils and turbine aerofoils tend to be different as they must be configured for their different applications and locations in the device in which they are provided.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 46. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48 and will be described in more detail below.

The aerofoil of the present disclosure is described with reference to the above exemplary turbine engine having a single shaft or spool connecting a single, multi-stage compressor and a single, one or more stage turbine. However, it should be appreciated that the aerofoil of the present disclosure is equally applicable to two or three shaft engines and which can be used for industrial, aero or marine applications. The term rotor or rotor assembly is intended to include rotating (i.e. rotatable) components, including rotor blades and a rotor drum. The term stator or stator assembly is intended to include stationary or non-rotating components, including stator vanes and a stator casing. Conversely the term rotor is intended to relate a rotating component, to a stationary component such as a rotating blade and stationary casing or a rotating casing and a stationary blade or vane. The rotating component can be radially inward or radially outward of the stationary component. The term aerofoil is intended to mean the aerofoil portion of a rotating blade or stationary vane.

The terms axial, radial and circumferential are made with reference to the rotational axis 20 of the engine.

Figure 3:
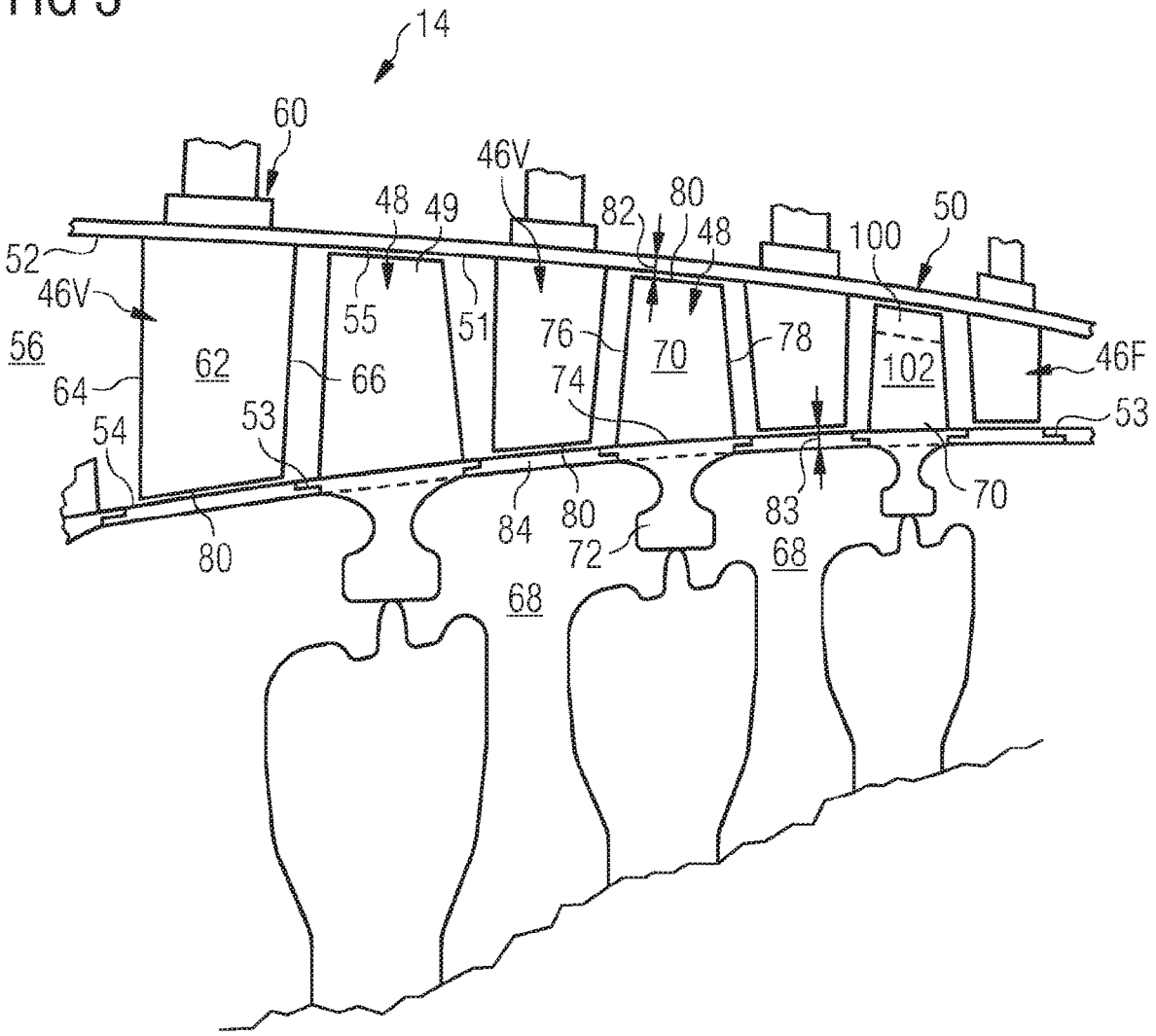
FIG. 3 shows an enlarged view of part of a compressor of the turbine engine of FIG. 2.

Referring to FIG. 3, the compressor 14 of the turbine engine 10 includes alternating rows of stator guide vanes 46 and rotatable rotor blades 48 which each extend in a generally radial direction into or across the passage 56.

The rotor blade stages 49 comprise rotor discs 68 supporting an annular array of blades. The rotor blades 48 are mounted between adjacent discs 68, but each annular array of rotor blades 48 could otherwise be mounted on a single disc 68. In each case the blades 48 comprise a mounting foot or root portion 72, a platform 74 mounted on the foot portion 72 and an aerofoil 70 having a leading edge 76, a trailing edge 78 and a blade tip 80. The aerofoil 70 is mounted on the platform 74 and extends radially outwardly therefrom towards the surface 52 of the casing 50 to define a blade tip gap, hg (which may also be termed a blade clearance 82).

The radially inner surface 54 of the passage 56 is at least partly defined by the platforms 74 of the blades 48 and compressor discs 68. In the alternative arrangement mentioned above, where the compressor blades 48 are mounted into a single disc the axial space between adjacent discs may be bridged by a ring 84, which may be annular or circumferentially segmented. The rings 84 are clamped between axially adjacent blade rows 48 and are facing the tip 80 of the guide vanes 46. In addition as a further alternative arrangement a separate segment or ring can be attached outside the compressor disc shown here as engaging a radially inward surface of the platforms.

FIG. 3 shows two different types of guide vanes, variable geometry guide vanes 46V and fixed geometry guide vanes 46F. The variable geometry guide vanes 46V are mounted to the casing 50 or stator via conventional rotatable mountings 60. The guide vanes comprise an aerofoil 62, a leading edge 64, a trailing edge 66 and a tip 80. The rotatable mounting 60 is well known in the art as is the operation of the variable stator vanes and therefore no further description is required. The guide vanes 46 extend radially inwardly from the casing 50 towards the radially inner surface 54 of the passage 56 to define a vane tip gap or vane clearance 83 therebetween.

Collectively, the blade tip gap or blade clearance 82 and the vane tip gap or vane clearance 83 are referred to herein as the 'tip gap hg'. The term 'tip gap' is used herein to refer to a distance, usually a radial distance, between the tip's surface of the aerofoil portion and the rotor drum surface or stator casing surface.

Although the aerofoil of the present disclosure is described with reference to the compressor blade and its tip, the aerofoil may also be provided as a compressor stator vane, for example akin to vanes 46V and 46F.

The present disclosure may relate to an un-shrouded compressor aerofoil and in particular may relate to a configuration of a tip of the compressor aerofoil to minimise aerodynamic losses.

The compressor aerofoil 70 comprises a suction surface wall 88 and a pressure surface wall 90 which meet at the leading edge 76 and the trailing edge 78. The suction surface wall 88 has a suction surface 89 and the pressure surface wall 90 has a pressure surface 91.

As shown in FIG. 3, the compressor aerofoil 70 comprises a root portion 72 spaced apart from a tip portion 100 by a main body portion 102.

Figure 4:
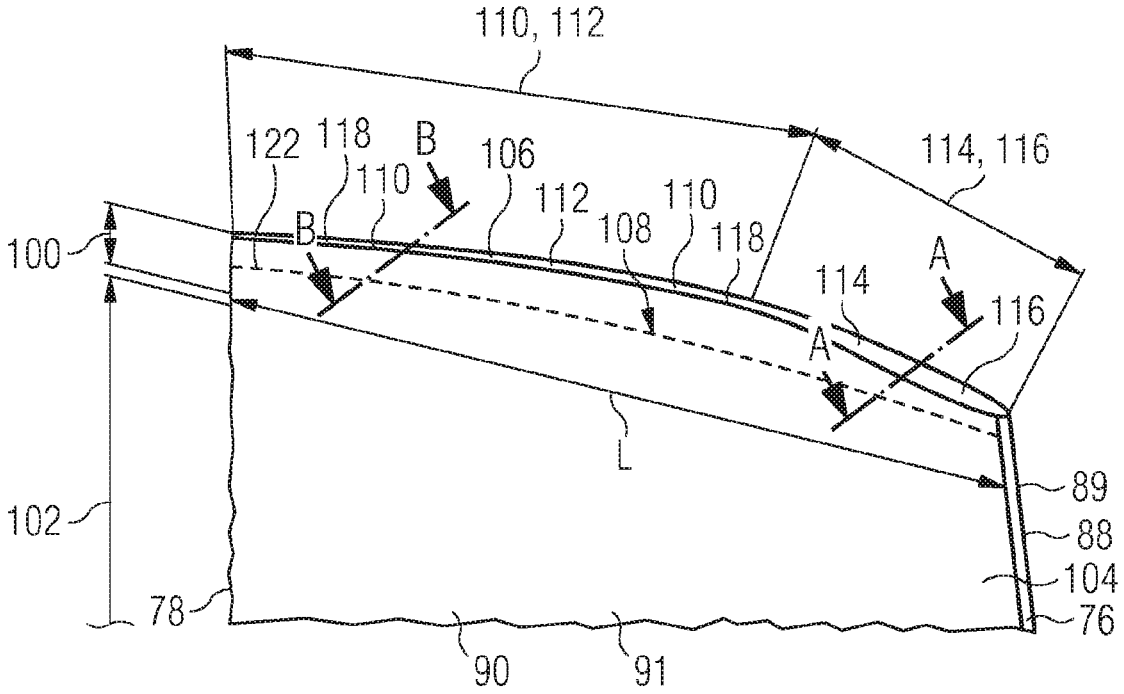
FIG. 4 shows part of a main body and a tip region of an aerofoil according to the present disclosure.
Figure 5A:
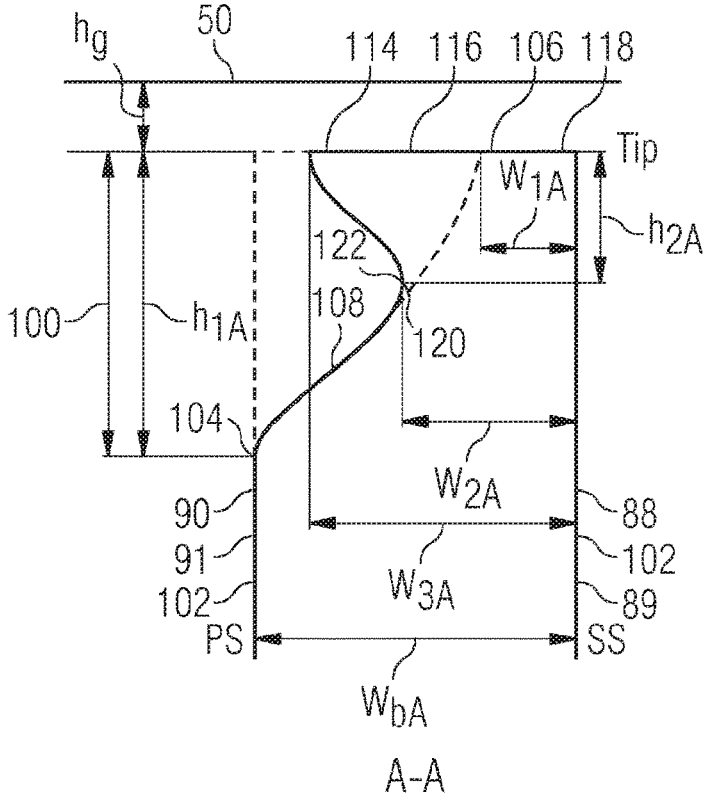
FIGS. 5*a*, 5*b* show sectional views of the aerofoil as indicated at A-A and B-B in FIG. 4.
Figure 5B:
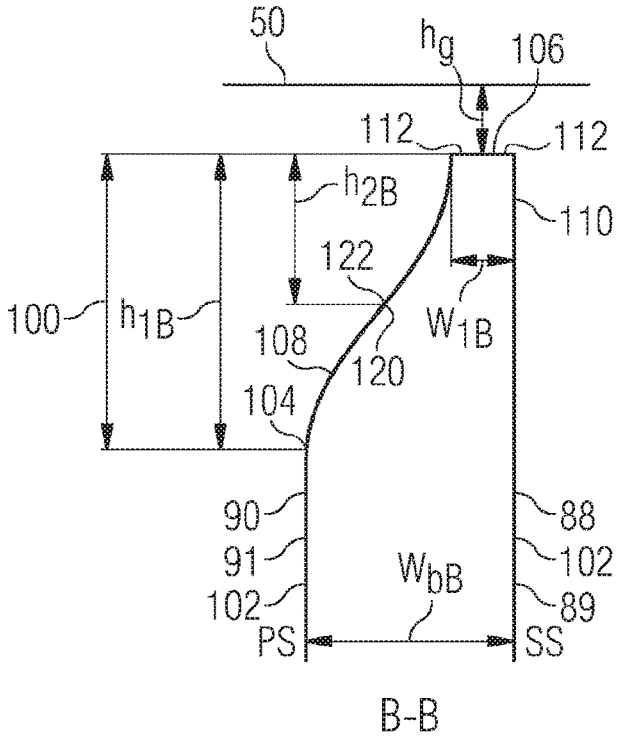
Figures 6, 7:
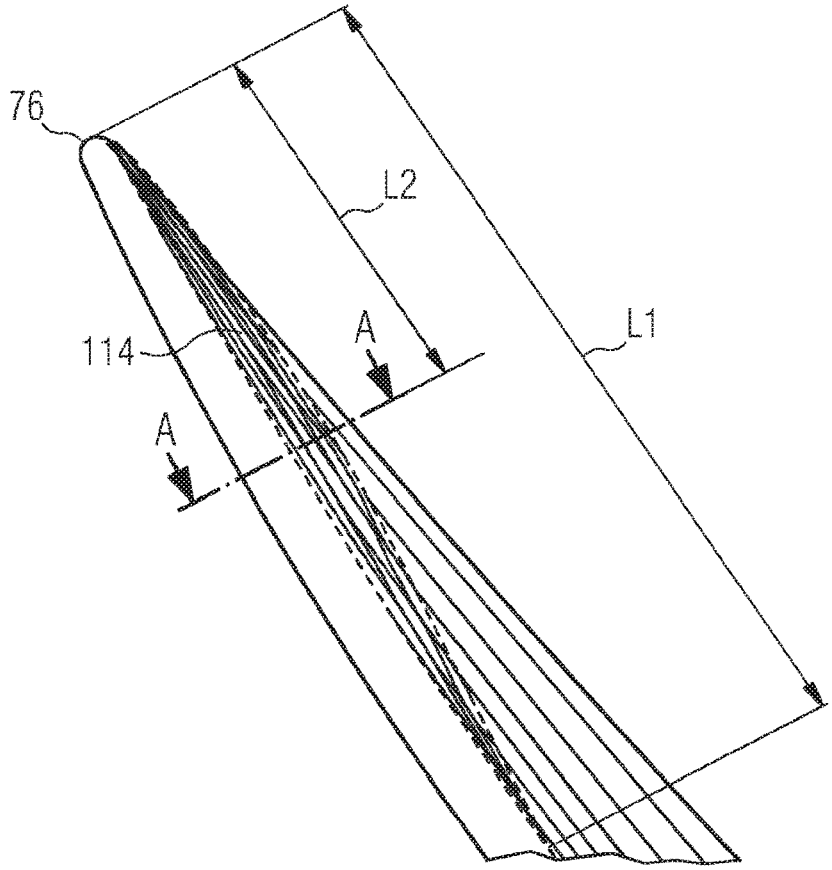
FIG. 6 shows an end on view of a part of the tip region of the aerofoil shown in FIG. 4.
FIG. 7 is a table of relative dimensions of the features shown in FIGS. 5*a*, 5*b*, 6.

FIG. 4 shows an enlarged view of part of a compressor aerofoil 70 according to the present disclosure. FIGS. 5*a*, 5*b* show sectional views of the aerofoil at points A-A and B-B as indicated in FIG. 4. FIG. 6 shows an end on view of a part of the tip region of the aerofoil 70, and FIG. 7 summarises the relationship between various dimensions as indicated in FIGS. 5*a*, 5*b*, 6.

The main body portion 102 is defined by the convex suction surface wall 88 having the suction surface 89 and the concave pressure surface wall 90 having the pressure surface 91. The suction surface wall 88 and the pressure surface wall 90 meet at the leading edge 76 and the trailing edge 78.

As shown in FIGS. 5*a*, 5*b*, the pressure surface 91 and the suction surface 89 are spaced apart by a distance wb, identified as wbA, wbB at sections A-A and B-B respectively. The distance between the pressure surface 91 and the suction surface 89 (i.e. value wb, wbA, wbB) decreases in value between the main body widest point and the leading edge 76. The distance between the pressure surface 91 and the suction surface 89 (i.e. the value wb, wbA, wbB) also decreases in value between the main body widest point and the trailing edge 78.

The suction surface wall 88 and pressure surface wall 90 each extend from the root portion 72 to the tip portion 100.

The tip portion 100 comprises a shoulder 104 provided on the pressure surface wall 90 between the leading edge 76 and the trailing edge 78. The shoulder 104 extends at least part of the way between the leading edge 76 and the trailing edge 78. The shoulder 104 may extend substantially the whole way between the leading edge 76 and the trailing edge 78.

The tip portion 100 further comprises a tip wall 106 which extends from the aerofoil leading edge 76 to the aerofoil trailing edge 78. The tip portion 100 also comprises a transition region 108 of the pressure surface wall 90 which tapers from the shoulder 104 in a direction towards the tip wall 106 such that the compressor aerofoil 70 is narrower at the tip wall 106 than between the pressure surface 91 and the suction surface 89 along the length of the shoulder 104.

The shoulder 104 and the transition region 108 are each defined in the cross-sectional view of FIGS. 5*a*, 5*b* and each extends along at least a part of the tip portion 100 between the leading edge and the trailing edge.

On the suction surface wall 88, the suction surface 89 of the tip portion 100 extends without interruption to the tip wall 106. That is to say, the profile of the suction surface wall 89 continues into and through the tip portion 100 to the tip wall 106. Put another way, in the tip portion 100, the suction surface 89 extends in the same direction (i.e. with the same curvature) towards the tip wall 106 as it does in the main body portion 102. That is to say, in the tip portion 100, the suction surface 89 extends from the main body portion 102 without transition and/or change of direction towards the tip wall 106.

The tip wall 106 comprises a squealer 110 defined by a first tip wall region 112 which extends from the trailing edge 78 to a winglet 114 defined by a second tip wall region 116 which increases in width relative to the first tip wall region 112 to a tip wall widest point (for example at A-A), and then reduces in width towards the leading edge 76.

In one example, the first tip wall region 112 which defines the squealer 110 has a substantially constant width w1B along its extent.

In a further example, the first tip wall region 112 which defines the squealer 110 has a width w1B which varies along its extent, tapering towards the trailing edge 78.

In another example, the squealer width w1B may have a value of at least about 0.1, but no more than about 0.2, of the distance wbB between pressure surface 91 and the suction surface 89 of the main body 102 along the extent of the squealer 110. The value wbB varies along the length of the tip portion 100, and hence the value of w1B may vary along the length of the tip portion 100.

Put another way, where the distance between pressure surface 91 and the suction surface 89 of the main body 102 along the extent of the squealer is wbB, the squealer width w1B may have a value of at least about 0.1 wbB but no more than about 0.2 wbB.

As indicated in FIGS. 4, 6, the winglet 114 may extend from the leading edge 76 towards the trailing edge 78 by a chord distance L1, where L1 may have a value of at least about 0.25, but no more than about 0.65, of the chord length L (i.e. chord line) from the leading edge 76 to the trailing edge 78.

For the avoidance of doubt, the term "chord" refers to an imaginary straight line which joins the leading edge 76 and trailing edge 78 of the aerofoil 70. Hence the chord length L is the distance between the trailing edge 78 and the point on the leading edge 76 where the chord intersects the leading edge.

Hence chord distance L1 above (and L2 below) refer to a sub-section of the chord line L.

Put another way, where a chord line from the leading edge 76 to the trailing edge 78 has a length L, the winglet 114 extends from the leading edge 76 towards the trailing edge 78 by a distance L1, where L1 may have a value of at least about 0.25 L but no more than about 0.65 L.

The widest point (for example at section A-A) of the winglet 114 may be at a distance L2 of at least about 0.4, but no more than about 0.6, of L1 from the leading edge 76.

Put another way, the widest point (for example at section A-A) of the winglet 114 may be at a chord distance of L2 from the leading edge 76, where L2 has a value of at least about 0.4 L1 but no more than about 0.6 L1.

As shown in FIG. 5*a*, along the length of the winglet 114, the winglet 114 is narrower than a distance wbA between the pressure surface 91 and the suction surface 89 in the corresponding region of winglet 114. That is to say, along the length of the winglet 114, the winglet is recessed beneath the pressure surface 91. Put another way, along the length of the winglet 114, the winglet does not extend beyond the limit of the pressure surface 91.

The widest point (for example at section A-A) of the winglet 114 may have a width w3A of at least about 0.8 wbA but no more than about 0.95 wbA.

The tip wall 106 defines a tip surface 118 which extends from the aerofoil leading edge 76 to the aerofoil trailing edge 78. At the widest point of the winglet 114 the transition region 108 of the pressure surface wall 90 extends from the shoulder 104 in a direction towards the suction surface 89. As shown in FIGS. 5*a*, 5*b*, at an inflexion point 120 the transition region 108 then curves to extend in a direction away from the suction surface 89 toward the tip surface 118. Hence the winglet 114 overhangs the transition region 108. Put another way, in the region of the winglet 114, the transition region 108 forms a channel. That is to say, in the region of the winglet 114, the transition region 108 defines a re-entrant feature which defines the overhang of the winglet 114.

The tip portion 100 further comprises an inflexion line 122 defined by a change in curvature on the pressure surface 91 and along with the inflexion point 120 is with respect to the cross-section view of FIGS. 5*a*, 5*b*. The inflexion line 122 extends between the leading edge 76 and the trailing edge 78. The inflexion points 120 are provided on the inflexion line 122. Put another way, the inflexion line 122 is defined by a series of curvature inflexion points 120 which extends from the leading edge 76 to the trailing edge 78 on the pressure surface wall 90 in the tip portion 100.

As shown in FIGS. 5*a*, 5*b*, the inflexion line 122 may be provided a distance h2A, h2B from the tip surface, and the shoulder 104 may be provided a distance h1A, h1B of at least about 1.5 times, but no more than about 2.7 times, the distance h2A of the inflexion line 122 from the tip surface 118.

Put another way, as shown in FIGS. 5*a*, 5*b*, the inflexion line 122 may be provided a distance h2A, h2B from the tip surface, and the shoulder 104 may be provided a distance h1A, h1B from the tip surface 118, where h1A, h1B may have a value of at least about 1.5 h2A but no more than about 2.7 h2A.

The inflexion line 122 at the widest point of the winglet 114 may be provided a distance w2A of at least about 0.8, but no more than about 0.95, of w3A from the suction surface 89.

Put another way, the inflexion line 122 at the widest point of the winglet 114 may be provided a distance w2A from the suction surface 89, wherein w2A may have a value of at least about 0.8 w3A but no more than about 0.95 w3A.

With reference to a compressor rotor assembly for a turbine engine comprising a compressor aerofoil according to the present disclosure, and as described above and shown in FIGS. 5*a*, 5*b*, the compressor rotor assembly comprises a casing 50 and a compressor aerofoil 70 wherein the casing 50 and the compressor aerofoil 70 define a tip gap, hg, defined between the tip surface and the casing.

In such an example the distance h2A, h2B from the inflexion line 122 to the tip surface has a value of at least about 1.5, but no more than about 3.5, of the tip gap hg. Put another way the distance h2A, h2B from the inflexion line 122 to the tip surface may have a value of at least about 1.5 hg but no more than about 3.5 hg. That is to say, the distance h2A, h2B from the inflexion line 122 to the tip surface may have a value of at least about 1.5 but no more than about 3.5 of a predetermined (i.e. desired) tip clearance gap hg.

Figure 1:
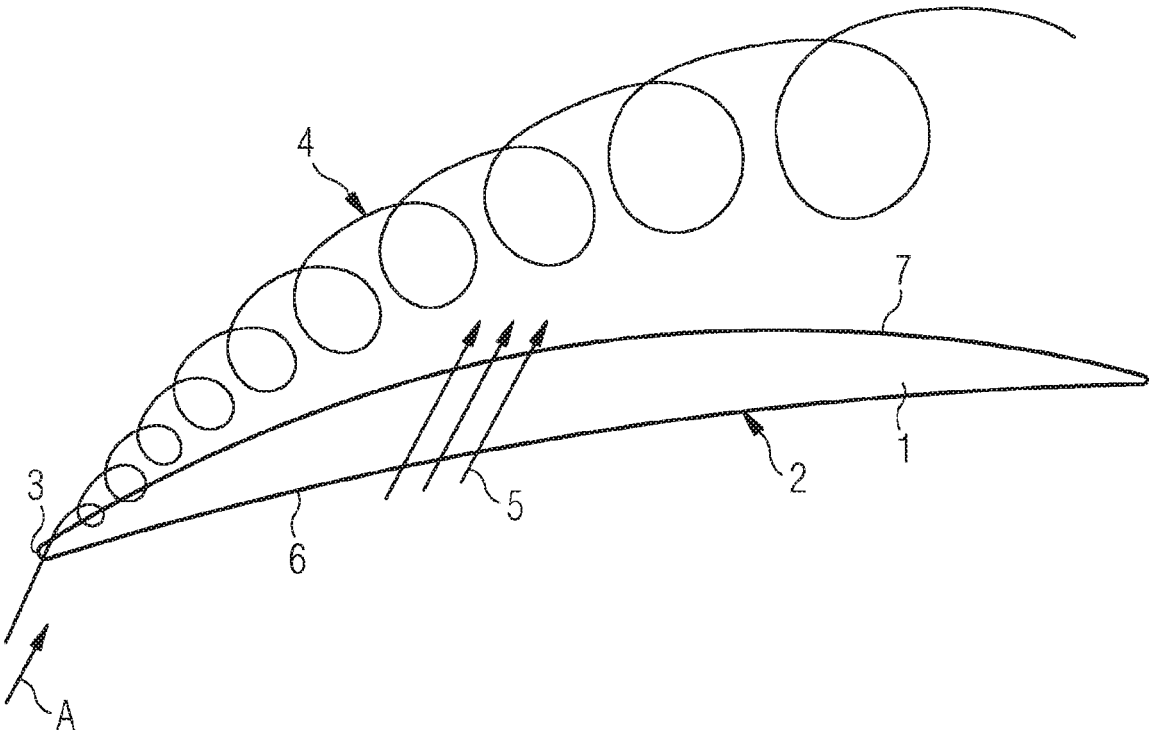
FIG. 1 shows an example aerofoil tip, as discussed in the background section.

In operation in a compressor, the geometry of the compressor aerofoil of the present disclosure differs in two ways from arrangements of the related art, for example as shown in FIG. 1.

The inflexions 120 (i.e. inflexion line 122) in the transition region 108 which forms the overhanging winglet 114 inhibits primary flow leakage by virtue of intrusion of the winglet 114 into the air flow directed radially (or with a radial component) along the pressure surface 91 towards the tip portion 100, and hence the tip flow vortex formed is of lower intensity than those of the related art.

The squealer 110, being narrower than the overall width of the main body 102, results in the pressure difference across the tip surface 118 being lower than if the tip surface 118 had the same cross section as the main body 102. Hence secondary flow across the tip surface 118 will be less than in examples of the related art, and the primary flow vortex formed is consequently of lesser intensity as there is less secondary flow feeding it than in examples of the related art.

Additionally, since the winglet 114 of the aerofoil 70 is within the boundary of the walls of main body 102 (i.e. as shown in FIG. 5*a*, is recessed below surface of the main body walls 88, 90, and does not extend beyond the main body walls 88, 90), the configuration is frictionally less resistant to movement than an example of the related art in which the winglet 114 extends beyond boundary of the walls of the main body 102. That is to say, since the winglet 114 of the present disclosure has a relatively small surface area, the frictional and aerodynamic forces generated by it with respect to the casing 50 will be less than in examples of the related art.

Thus the amount of over tip leakage flow flowing over the tip surface 118 is reduced, as is potential frictional resistance. The reduction in the amount of over tip leakage flow is beneficial because there is then less interaction with (e.g. feeding of) the over tip leakage vortex.

Hence there is provided an aerofoil rotor blade and/or stator vane for a compressor for a turbine engine configured to reduce tip leakage flow and hence reduce strength of the interaction between the leakage flow and the main stream flow, which in turn reduces overall loss in efficiency.

As described, the aerofoil is reduced in thickness towards its tip to form a squealer on the suction (convex) side of the aerofoil, which reduces the pressure difference across the tip and hence reduces secondary leakage flow. The winglet is provided on the pressure side near the leading edge which acts to diminish primary leakage flow. Together, these features reduce the tip leakage mass flow thus diminishing the strength of the interaction between the leakage flow and the main stream flow which in turn reduces the loss in efficiency.

Hence the compressor aerofoil of the present disclosure results in a compressor of greater efficiency compared to known arrangements.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least about some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A compressor aerofoil for a turbine engine, the compressor aerofoil comprising:

a root portion spaced apart from a tip portion by a main body portion;

wherein the main body portion is defined by: a suction surface wall having a suction surface, a pressure surface wall having a pressure surface, whereby the suction surface wall and the pressure surface wall meet at a leading edge and a trailing edge, wherein the tip portion comprises a shoulder provided on the pressure surface wall between the leading edge and the trailing edge; a tip wall which extends from the leading edge to the trailing edge; a transition region of the pressure surface wall which tapers from the shoulder in a direction towards the tip wall, wherein the tip wall comprises a squealer defined by a first tip wall region which extends from the trailing edge to a winglet defined by a second tip wall region which increases in width relative to the first tip wall region to a tip wall widest point (A-A), and then reduces in width towards the leading edge wherein a distance between the pressure surface and the suction surface of the main body along the extent of the squealer is wbB, wherein a squealer width w1B has a value of at least 0.1 wbB but no more than 0.2 wbB.

2. The compressor aerofoil as claimed in claim 1, wherein the first tip wall region which defines the squealer has a substantially constant width w1B along its extent.

3. The compressor aerofoil as claimed in claim 1, wherein a chord line from the leading edge to the trailing edge has a length L; and wherein the winglet extends from the leading edge towards the trailing edge by a distance L1, where L1 has a value of at least 0.25 L but no more than 0.65 L.

4. The compressor aerofoil as claimed in claim 1, wherein the pressure surface and the suction surface are spaced apart at a first section of the compressor aerofoil by a distance wbA and wherein the pressure surface and the suction surface are spaced apart at a second section of the compressor aerofoil by the distance wbB, wherein the first section is along the main body widest point (A-A), and wherein a second section (B-B) is along the squealer; and wherein the distance wbA at the first section of the aerofoil decreases in value between the main body wides point (A-B) and the leading edge; and wherein the distance wbB at the second section of the aerofoil decreases in value between the main body widest point (A-A) and the trailing edge.

5. A compressor rotor assembly for a turbine engine, the compressor rotor assembly comprising:

a casing, and a compressor aerofoil as claimed in claim 1, wherein the casing and the compressor aerofoil define a tip gap hg defined between the tip surface and the casing.

6. A compressor aerofoil for a turbine engine, the compressor aerofoil comprising:

a root portion spaced apart from a tip portion by a main body portion;

wherein the main body portion is defined by: a suction surface wall having a suction surface, a pressure surface wall having a pressure surface, whereby the suction surface wall and the pressure surface wall meet at a leading edge and a trailing edge, wherein the tip portion comprises a shoulder provided on the pressure surface wall between the leading edge and the trailing edge; a tip wall which extends from the leading edge to the trailing edge; a transition region of the pressure surface wall which tapers from the shoulder in a direction towards the tip wall, wherein the tip wall comprises a squealer defined by a first tip wall region which extends from the trailing edge to a winglet defined by a second tip wall region which increases in width relative to the first tip wall region to a tip wall widest point (A-A), and then reduces in width towards the leading edge, wherein a chord line from the leading edge to the trailing edge has a length L; and wherein the winglet extends from the leading edge towards the trailing edge by a distance L1, where L1 has a value of at least 0.25 L but no more than 0.65 L, wherein a widest point (A-A) of the winglet is at a distance of L2 from the leading edge, where L2 has a value of at least 0.4 L1 but no more than 0.6 L1.

7. A compressor aerofoil for a turbine engine, the compressor aerofoil comprising:

a root portion spaced apart from a tip portion by a main body portion;

wherein the main body portion is defined by: a suction surface wall having a suction surface, a pressure surface wall having a pressure surface, whereby the suction surface wall and the pressure surface wall meet at a leading edge and a trailing edge, wherein the tip portion comprises a shoulder provided on the pressure surface wall between the leading edge and the trailing edge; a tip wall which extends from the leading edge to the trailing edge; a transition region of the pressure surface wall which tapers from the shoulder in a direction towards the tip wall, wherein the tip wall comprises a squealer defined by a first tip wall region which extends from the trailing edge to a winglet defined by a second tip wall region which increases in width relative to the first tip wall region to a tip wall widest point (A-A), and then reduces in width towards the leading edge, wherein along a length of the winglet, the winglet is narrower than a distance wbA between the pressure surface and the suction surface in a corresponding region of the winglet.

8. A compressor aerofoil for a turbine engine, the compressor aerofoil comprising:

a root portion spaced apart from a tip portion by a main body portion;

wherein the main body portion is defined by: a suction surface wall having a suction surface, a pressure surface wall having a pressure surface, whereby the suction surface wall and the pressure surface wall meet at a leading edge and a trailing edge, wherein the tip portion comprises a shoulder provided on the pressure surface wall between the leading edge and the trailing edge; a tip wall which extends from the leading edge to the trailing edge; a transition region of the pressure surface wall which tapers from the shoulder in a direction towards the tip wall, wherein the tip wall comprises a squealer defined by a first tip wall region which extends from the trailing edge to a winglet defined by a second tip wall region which increases in width relative to the first tip wall region to a tip wall widest point (A-A), and then reduces in width towards the leading edge, wherein along a length of the winglet, the winglet is recessed beneath the pressure surface.

9. A compressor aerofoil for a turbine engine, the compressor aerofoil comprising:

a root portion spaced apart from a tip portion by a main body portion;

wherein the main body portion is defined by: a suction surface wall having a suction surface, a pressure surface wall having a pressure surface, whereby the suction surface wall and the pressure surface wall meet at a leading edge and a trailing edge, wherein the tip portion comprises a shoulder provided on the pressure surface wall between the leading edge and the trailing edge; a tip wall which extends from the leading edge to the trailing edge; a transition region of the pressure surface wall which tapers from the shoulder in a direction towards the tip wall, wherein the tip wall comprises a squealer defined by a first tip wall region which extends from the trailing edge to a winglet defined by a second tip wall region which increases in width relative to the first tip wall region to a tip wall widest point (A-A), and then reduces in width towards the leading edge, wherein along a length of the winglet, the winglet is narrower than a distance wbA between the pressure surface and the suction surface in a corresponding region of the winglet wherein a widest point (A-A) of the winglet has width w3A of at least 0.8 wbA but no more than 0.95 wbA.

10. The compressor aerofoil as claimed in claim 9, wherein the tip wall defines a tip surface which extends from the leading edge to the trailing edge;

wherein at the widest point (A-A) of the winglet the transition region of the pressure surface wall extends from the shoulder in a direction towards the suction surface, and wherein at an inflexion point the transition region curves to extend in a direction away from the suction surface toward the tip surface.

11. The compressor aerofoil as claimed in claim 10, wherein the tip portion further comprises an inflexion line defined by a change in curvature on the pressure surface;

the inflexion point being provided on the inflexion line; and the inflexion line extending between the leading edge and the trailing edge.

12. The compressor aerofoil as claimed in claim 11, wherein the inflexion line is provided a distance h2A, h2B from the tip surface; and wherein the shoulder is provided a distance h1A, h1B from the tip surface;

where distance h1A, h1B has a value of at least 1.5 h2A but no more than 2.7 h2A.

13. A compressor rotor assembly for a turbine engine, the compressor rotor assembly comprising:

a casing, and a compressor aerofoil as claimed in claim 12, wherein the casing and the compressor aerofoil define a tip gap hg defined between the tip surface and the casing, and wherein the distance h2A, h2B from the inflexion line to the tip surface has a value of at least 1.5 hg but no more than 3.5 hg.

14. The compressor aerofoil as claimed in claim 11, wherein the inflexion line at the widest point of the winglet is provided a distance w2A from the suction surface;

wherein w2A has a value of at least 0.8 w3A but no more than 0.95 w3A.

* * * * *